US005264021A

United States Patent [19]

Kita et al.

[11] Patent Number: 5,264,021

[45] Date of Patent: Nov. 23, 1993

[54] COMPACTED AND CONSOLIDATED ALUMINUM-BASED ALLOY MATERIAL AND PRODUCTION PROCESS THEREOF

[75] Inventors: Kazuhiko Kita, Uozu; Makoto Kawanishi; Hidenobu Nagahama, both of Kurobe, all of Japan

[73] Assignee: Yoshida Kogyo K.K., Tokyo, Japan

[21] Appl. No.: 930,733

[22] Filed: Aug. 14, 1992

[30] Foreign Application Priority Data

Sep. 27, 1991 [JP] Japan ..... 3-249396
Feb. 17, 1992 [JP] Japan ..... 4-29366

[51] Int. Cl.[5] ..... B22F 3/02; C22C 21/00

[52] U.S. Cl. ..... 75/249; 419/66; 419/67; 148/549; 148/550; 148/438; 148/440; 420/551; 420/552; 428/548

[58] Field of Search ..... 75/249; 420/550, 551, 420/552, 587; 148/538, 549, 550, 438, 439, 440; 419/66, 67; 428/548

[56] References Cited

U.S. PATENT DOCUMENTS

| | | | |
|---|---|---|---|
| 3,020,154 | 2/1962 | Ida | 420/551 |
| 4,033,794 | 7/1977 | Stowell et al. | 420/551 |
| 4,464,199 | 8/1984 | Hildeman et al. | 75/249 |
| 4,676,830 | 6/1987 | Inumaru et al. | 75/249 |
| 4,743,317 | 5/1988 | Skinner et al. | 148/437 |
| 4,832,741 | 5/1989 | Couper | 75/249 |
| 4,851,193 | 7/1989 | Mahajan et al. | 420/550 |
| 4,891,068 | 1/1990 | Masumoto et al. | 75/251 |
| 4,917,730 | 4/1990 | Adam et al. | 148/437 |
| 4,948,558 | 8/1990 | Skinner et al. | 420/540 |
| 4,950,452 | 8/1990 | Masumoto et al. | 420/550 |
| 4,964,927 | 10/1990 | Shiflet et al. | 148/403 |
| 5,122,205 | 6/1992 | Masumoto et al. | 148/403 |
| 5,154,780 | 10/1992 | Dremkumar | 428/553 |

FOREIGN PATENT DOCUMENTS

| | | | |
|---|---|---|---|
| 87785 | 3/1989 | Japan | 420/551 |

*Primary Examiner*—Donald P. Walsh
*Assistant Examiner*—Ngoclan T. Mai
*Attorney, Agent, or Firm*—Flynn, Thiel, Boutell & Tanis

[57] ABSTRACT

A compacted and consolidated aluminum-based alloy material is obtained by compacting and consolidating a rapidly-solidified material having a composition represented by the general formula: $Al_aNi_bX_cM_d$ or $Al_{a'}Ni_bX_cM_dQ_e$, where X is one or two elements selected from La and Ce or an Mm; M is Zr or Ti; Q is one or more elements selected from Mg, Si, Cu and Zn, and a, a', b, c, d and e are, in atomic percentages, $84 \leqq a \leqq 94.8$, $82 \leqq a' \leqq 94.6$, $5 \leqq b \leqq 10$, $0.1 \leqq c \leqq 3$, $0.1 \leqq d \leqq 3$, and $0.2 \leqq e \leqq 2$. According to the production process of the invention, powder or flakes obtained by rapidly solidifying are compacted, followed by compressing, forming and consolidating by conventional plastic working operations. The consolidated material has an elongation sufficient to withstand secondary working operations. Moreover, the material retains the excellent properties of its raw material as they are.

8 Claims, 4 Drawing Sheets

THIN SOLID CURVES:
$Al_{92.3-x}Ni_{7.5}Zr_{0.2}Mm_x$

THICK SOLID CURVES:
$Al_{92.1-x}Ni_{7.5}Zr_{0.2}Cu_{0.2}Mm_x$

DOTTED CURVES:
$Al_{92.5-x}Ni_{7.5}Mm_x$

COMPACTED AND CONSOLIDATED ALUMINUM-BASED ALLOY MATERIAL AND PRODUCTION PROCESS THEREOF

BACKGROUND OF THE INVENTION

1. Field of the Invention

The present invention relates to a compacted and consolidated aluminum-based alloy material having not only a high strength but also an elongation sufficient to withstand practically-employed working, and also to a process for the production of the material.

2. Description of the Prior Art

Aluminum-based alloys having high strength and high heat resistance have been produced to date by liquid quenching or the like. In particular, the aluminum alloys disclosed in Japanese Patent Application Laid-Open (Kokai) No. HEI 1-275732 and obtained by liquid quenching are amorphous or microcrystalline and are excellent alloys having high strength, high heat resistance and high corrosion resistance.

The conventional aluminum-based alloys referred to above exhibit high strength, high heat resistance and high corrosion resistance and are excellent alloys. When they are each obtained in the form of powder or flakes by liquid quenching and the powder or flakes are then processed or worked as a raw material in one way or another to obtain a final product, in other words, the powder or flakes are converted into a final product by primary processing or working, they are excellent in processability or workability. However, to form the powder or flakes as a raw material into a consolidated material and then to work the consolidated material, namely, to subject the consolidated material to secondary working, there is still room for improvement in their workability and also in the retention of their excellent properties after the working.

SUMMARY OF THE INVENTION

An object of the present invention is, therefore, to provide a compacted and consolidated aluminum-based alloy material having a particular composition that permits easy working upon subjecting the material to secondary working (extrusion, forging, cutting or the like) and allows the retention excellent properties of the material even after the working.

The present assignee has already filed a patent application on a compacted and consolidated Al-Ni-X (X: at least one selected from among La, Ce and Mm) alloy material, to which Japanese Patent Application No. HEI 3-181065 (filed: Jul. 22, 1991) has been allotted. It is the object of the invention of the above application to provide a consolidated material having an elongation required at least upon application of secondary working and a strength higher than commercial high-strength Al alloys.

An invention of the present object is to improve, based on the consolidated material of the above alloy system, the workability upon secondary working and also the retention of properties after the secondary working.

In a first aspect of this invention, there is thus provided a compacted and consolidated aluminum-based alloy material which has been obtained by compacting and consolidating a rapidly solidified material having a composition represented by the general formula: $Al_a Ni_b X_c M_d$, wherein X is one or two elements selected from La and Ce or an Mm; M is one or two elements selected from Zr and Ti; a, b, c and d are, in atomic percentages, $84 \leqq a \leqq 94.8$, $5 \leqq b \leqq 10$, $0.1 \leqq c \leqq 3$, and $0.1 \leqq d \leqq 3$.

In a second aspect of this invention, there is also provided a compacted and consolidated aluminum-based alloy material which has been obtained by compacting and consolidating a rapidly solidified material having a composition represented by the general formula: $Al_{a'} Ni_b X_c M_d Q_e$, wherein X is one or two elements selected from La and Ce or an Mm; M is one or two elements selected from Zr and Ti; Q is at least one element selected from Mg, Si, Cu and Zn, and a', b, c, d and e are, in atomic percentages, $82 \leqq a' \leqq 94.6$, $5 \leqq b \leqq 10$, $0.1 \leqq c \leqq 3$, $0.1 \leqq d \leqq 3$, and $0.2 \leqq e \leqq 2$.

Preferably, in each of the above consolidated materials, the matrix is formed of aluminum or a supersaturated aluminum solid solution, whose mean crystal grain size is 40–1000 nm, grains made of a stable or metastable phase of various intermetallic compounds formed of the matrix element and the other alloying elements or of various intermetallic compounds formed of the other alloying elements are distributed evenly in the matrix, and the intermetallic compounds have a mean grain size of 10–800 nm.

In a third aspect of the present invention, there is also provided a process wherein a material of the composition represented by either the former general formula or the latter general formula is molten and then quenched and solidified into powder or flakes and, thereafter, the powder or flakes are compacted and then compressed, formed and consolidated by conventional plastic working. In this case, the powder or flakes as the raw material are required to be amorphous, a supersaturated solid solution or miorocrystalline such that the mean crystal grain size of the matrix is not greater than 1000 nm and the mean grain size of intermetallic compounds is 10–800 nm or to be in a mixed phase thereof. When the raw material is amorphous, it can be converted into such a microcrystalline or mixed phase as defined above by heating it to a temperature of 50° to 550 ° C., preferably 350° to 450 ° C., upon compaction.

The term "conventional plastic working" as used herein should be interpreted in a broad sense and should embrace pressure forming techniques and powder metallurgical techniques.

DETAILED DESCRIPTION OF THE PREFERRED EMBODIMENTS

Figure 1:
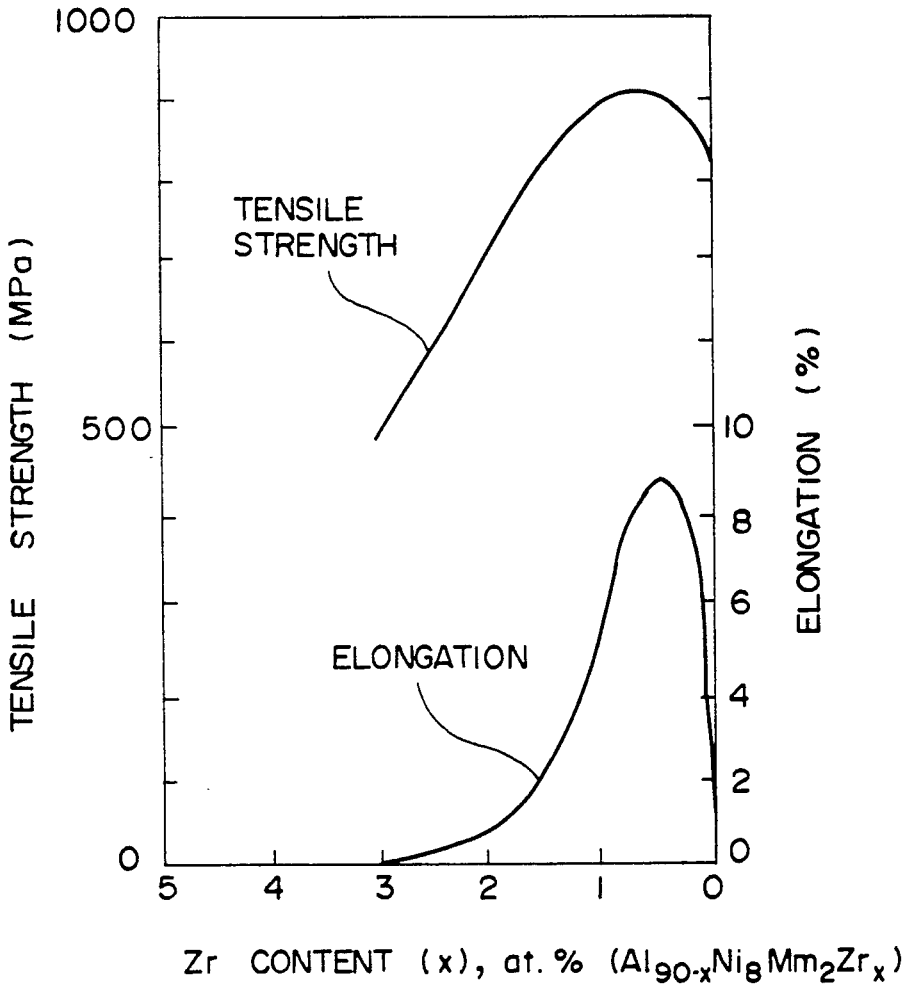
FIG. 1 is a graph showing variations in tensile strength and elongation at room temperature among the consolidated materials in Example 1.

The proportions a, a', b, c, d and e are limited, in atomic percentages, to the ranges of 84–94.8%, 82–94.6%, 5–10%, 0.1–3%, 0.1–3%, and 0.2–2%, respectively, in the general formulae in the first and second aspects of the present invention, because the alloys within the above ranges have higher room-temperature strength than conventional (commercial) high-strength aluminum alloys and are also equipped with ductility (elongation) sufficient to withstand practically-employed working. In view of the high strength of Al-Ni-X alloys up to 200 ° C. as shown in Japanese Patent Application No. HEI 3-181065, high strength is available at room temperature to 200 ° C. within the above ranges. Further, within the above-described ranges, cold working can be performed easily, to say nothing of hot and warm working below 400 ° C. In the above compositional range, c plus d (c+d) is preferably in the range of 0.5 to 5%. When the c+d is at least 0.5%, the matrix is further refined and a very high thermal stability can be expected. Therefore, a further improved strength can be obtained both at room temperature and elevated temperatures. On the other hand, c+d of not greater than 5% provides a high ductility at room temperature sufficient to withstand practically-employed working.

In the consolidated alloy materials according to this invention, Ni is an element having a relatively small ability to diffuse into the Al matrix. As it is contained together with element X, various stable or metastable, fine intermetallic compounds are formed and distributed as fine grains in the Al matrix. Ni is therefore effective not only in strengthening the matrix but also in inhibiting extraordinary coarsening of crystal grains. In other words, Ni improves the hardness and strength of the alloy to significant extents, stabilizes the microcrystalline phase at elevated temperatures, to say nothing of room temperature, and imparts heat resistance.

On the other hand, element X stands for one or two elements selected from La and Ce or for Mm. It is an element having a small ability to diffuse in the Al matrix. As it is contained together with element Ni, it forms stable intermetallic compounds, thereby contributing to the stabilization of the microcrystalline structure. Further, its combination with the above element can impart ductility required to apply conventional working. Incidentally, Mm is the common name for composite materials formed of La and Ce as principal elements and, in addition, containing rare earth (lanthanoid) elements other than La and Ce described above and inevitable impurities (Si, Fe, Mg, Al, etc.). Mm can substitute for La and/or Ce at the ratio of approximately 1 to 1 (by atom percent) and is economical, whereby Mm has a substantial advantage in economy.

Element M is one or two elements selected from Zr and Ti. Zr and Ti form intermetallic compounds with Al and are distributed as fine particles in the Al matrix, thereby contributing toward making finer the texture of the Al matrix, improving the ductility of the Al matrix and also strengthening the Al matrix.

A consolidated material of still higher strength can be obtained by adding Zr and/or Ti as a substitute for the Al in an AlNiMm alloy. Further, the ductility of an AlNiMm alloy can by improved by adding Zr and/or Ti as a substitute for the Mm in the AlNiMm alloy.

Element Q is one or more elements selected from Mg, Si, Cu and Zn. Mg, Si, Cu and Zn form intermetallic compounds with Al and they also form intermetallic compounds among themselves, thereby strengthening the Al matrix and improving the heat resistance. In addition, specific strength and specific elasticity are also improved.

In the consolidated aluminum-based alloy materials according to the present invention, the mean crystal grain size of the matrix, is limited to the range of 40–1000 nm for the following reasons. Mean crystal grain sizes of the matrix, smaller than 40 nm are too small to provide sufficient ductility despite high strength. To obtain ductility required for conventional working, a mean crystal grain size of the matrix of at least 40 nm is therefore needed. If the mean crystal grain size of the matrix exceeds 1000 nm, on the other hand, the strength drops abruptly, thereby making it impossible to obtain a consolidated material having high strength. To obtain a consolidated material having high strength, a mean crystal grain size of the matrix not greater than 1000 nm is hence needed. Further, the mean grain size of the intermetallic compounds is limited to the range of 10–800 nm because intermetallic compounds with a mean grain size outside the above range cannot serve as strengthening elements for the Al matrix. If the intermetallic compounds have a mean grain size smaller than 10 nm, they do not contribute to the strengthening of the Al matrix and, if they are present in the state of solid solution in an amount greater than that needed in the matrix, there is the potential problem of embrittlement. Mean grain sizes greater than 800 nm, on the other hand, result in unduly large grains so that the Al matrix cannot retain its strength and the intermetallic compounds cannot serve as strengthening elements. The restriction to the above ranges, therefore, leads to improvements in Young's modulus, high-temperature strength and fatigue strength.

In the consolidated aluminum-base alloy material according to the present invention, the mean crystal grain size of the matrix and the mean grain size of the intermetallic compounds can be controlled by choosing suitable conditions for its production. The mean crystal grain size of the matrix and the mean grain size of the intermetallic compounds should be controlled to be small where an importance is placed on the strength. In contrast, they should be controlled to be large where the ductility is considered important. In this manner, it is possible to obtain consolidated aluminum-based alloy materials which are suited for various purposes, respectively.

Further, the control of the mean crystal grain size of the matrix to the range of 40–1000 nm makes it possible to impart properties so that the resulting material can be used as an excellent superplastic working material.

The present invention will hereinafter be described specifically on the basis of the following examples.

EXAMPLE 1

Aluminum-based alloy powder having a desired composition ($Al_{92-x}Ni_8Mm_2Zr_x$) was produced by a gas atomizing apparatus. The aluminum-based alloy powder so produced was filled in a metal capsule and, while being degassed, was formed into an extrusion billet. The billet was extruded at 200°–550 ° C. through an extruder.

Mechanical properties (tensile strength and elongation) of the extruded material (solidified material) obtained under the above production conditions are shown in FIG. 1.

As is depicted in FIG. 1, it is understood that the tensile strength of the consolidated material at room temperature abruptly increased at Zr contents of not greater than 2.5 at. %. The elongation also abruptly increased at Zr contents of not greater than 2.5 at%.

It is also seen that the minimum elongation (2%) required for general working can be obtained at the Zr content of 1.5 at. %. When working a high-strength extruded material by cold working (i.e., by working it at a temperature close to room temperature), it is hence understood that the working is feasible at a Zr content not higher than 1.5 at. %. For the sake of comparison, the tensile strength of a conventional, consolidated high-strength aluminum-based alloy material (an extruded material of duralumin) was also measured at room temperature. As a result, the tensile strength was found to be about 650 MPa. It is also understood from this value that the above solidified material of the present invention is excellent in strength at Zr content not greater than 2.5 at. %.

The Young's moduli of consolidated materials obtained under the above production conditions were also investigated. The Young's moduli of the consolidated materials according to the present invention were as high as 800 - 12000 kgf/mm$^2$ as opposed to about 7000 kg/mm$^2$ of the conventional high-strength Al alloy (duralumin). The consolidated materials according to the present invention therefore exhibit the advantages that their deflection and deformation are smaller under the same load.

EXAMPLE 2

Figure 2:
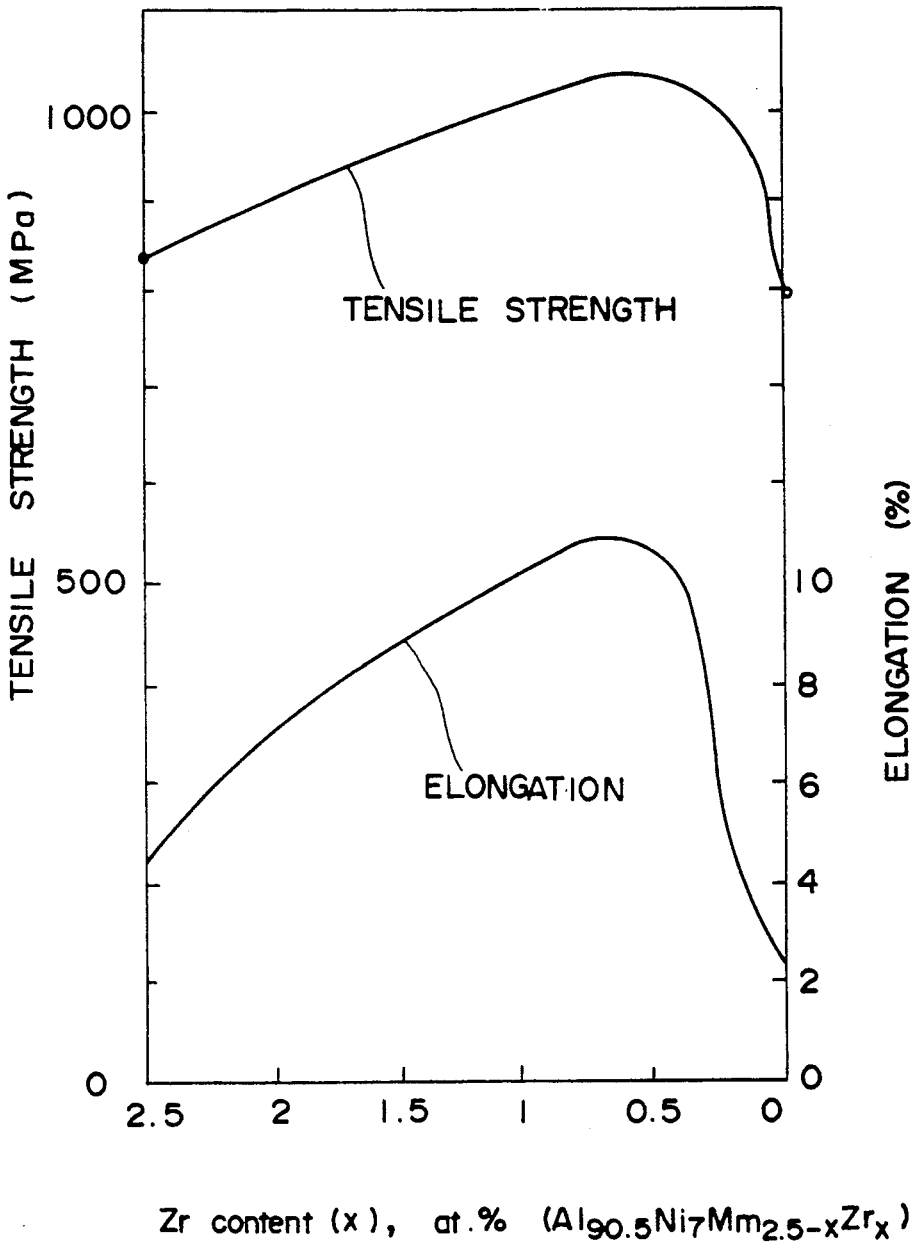
FIG. 2 is also a graph depicting variations in tensile strength and elongation at room temperature among the consolidated materials in Example 2.

As in Example 1 described above, $Al_{90.5}Ni_7Mm_{2.5-x}Zr_x$ powders were prepared. Billets were then produced likewise and extruded materials (consolidated materials) were obtained eventually. Mechanical properties (tensile strength and elongation) of these extruded materials at room temperature are diagrammatically shown in FIG. 2. As is shown in FIG. 2, it is understood that the tensile strength of the consolidated material at room temperature gradually increased from the Zr content of 2.5 at. % and downward but abruptly dropped at Zr contents less than 0.1%. It is also envisaged that the elongation gradually increased from the Zr content of 2.5 at. % and downward but abruptly decreased at Zr contents less than 0.3 at. %. It is also seen that the minimum elongation (2%) required for ordinary working operations is available within a Zr content range of 0–2.5 at. %. When the tensile strength is compared with that of a conventional high-strength aluminum-based alloy material (duralumin), it is understood that the consolidated materials according to this invention are superior over the entire Zr content range of 0–2.5 at. %.

EXAMPLE 3

Figure 3:
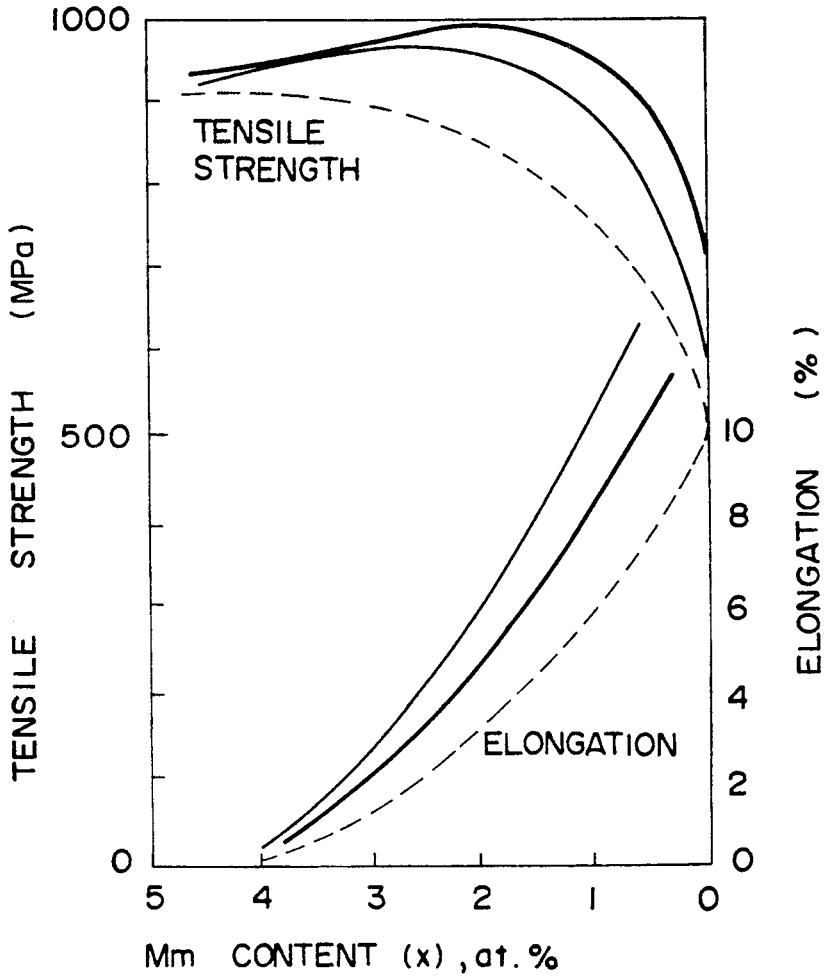
FIG. 3 is also a graph showing variations in tensile strength and elongation at room temperature among the consolidated materials in Example 3.

As in Example 1 described above, $Al_{92.3-x}Ni_{7.5}Zr_{0.2}Mm_x$ and $Al_{92.1-x}Ni_{7.5}Zr_{0.2}Cu_{0.2}Mm_x$ powders were prepared. Billets were then produced likewise and extruded materials (consolidated materials) were obtained eventually. Mechanical properties (tensile strength and elongation) of these extruded materials at room temperature are diagrammatically shown in FIG. 3. For the sake of comparison, the mechanical properties of $Al_{92.5-x}Ni_{7.5}Mm_x$, the subject matter of Japanese Patent Application No. HEI 3-181065 filed by the present assignee, are also shown in FIG. 3. In FIG. 3, thin solid curves indicate $Al_{92.3}Ni_{7.5}Zr_{0.2}Mm_x$, thick solid curves designate $Al_{92.1-x}Ni_{7.5}Zr_{0.2}Cu_{0.2}Mm_x$, and dotted curves correspond to $Al_{92.5-x}Ni_{7.5}Mm_x$. As is illustrated in FIG. 3, the consolidated materials ($Al_{92.3-x}Ni_{7.5}Zr_{0.2}Mm_x$ and $Al_{92.1-x}Ni_{7.5}Zr_{0.2}Cu_{0.2}Mm_x$) are found to have superior properties in their tensile strength and elongation to the consolidated material ($Al_{92.5-x}Ni_{7.5}Mm_x$) as a comparative example. It is also understood that the addition of Cu as a fifth element to the consolidated materials of the present invention ($Al_{92.3-x}Ni_{7.5}Zr_{0.2}Mm_x$ and $Al_{92.1-x}Ni_{7.5}Zr_{0.2}Cu_{0.2}Mm_x$) can improve their tensile strength although their elongation is slightly reduced.

EXAMPLE 4

Figure 4:
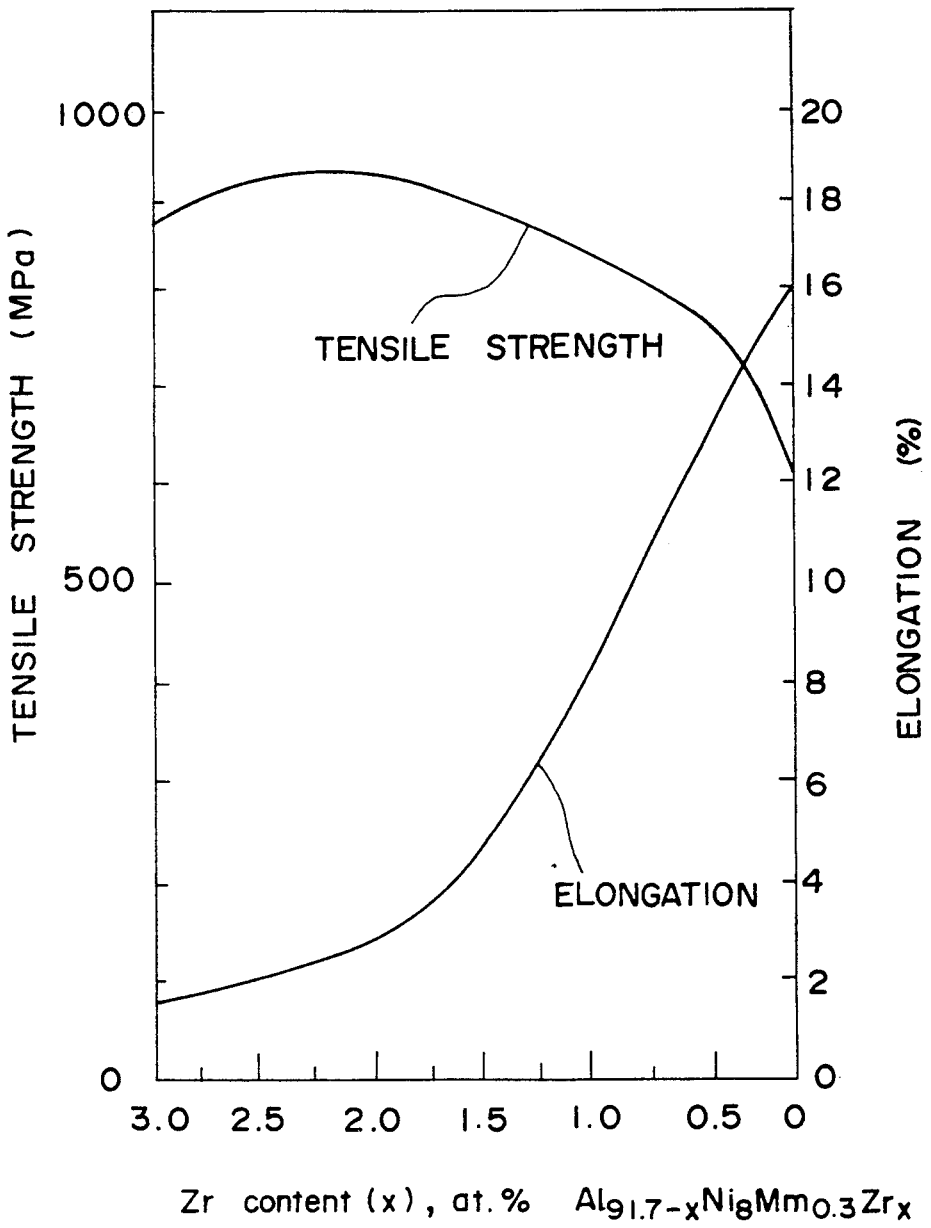
FIG. 4 is also a graph showing variations in tensile strength and elongation at room temperature among the extruded materials in Example 4.

As in Example 1 described above, $Al_{91.7-x}Ni_8Mm_{0.3}Zr_x$ powders were prepared. Billets were then produced likewise and extruded materials (consolidated materials) were obtained eventually. Mechanical properties (tensile strength and elongation) of these extruded materials at room temperature are diagrammatically shown in FIG. 4. As is shown in FIG. 4, it is understood that the tensile strength of the consolidated material at room temperature abruptly dropped at Zr contents less than 0.1%. It is also envisaged that the elongation gradually increased from the Zr content of 2.5 at. % and downward. It is also seen that the minimum elongation (2%) required for ordinary working operations is available within a Zr content range of 0–2.5 at. %. When the tensile strength is compared with that of a conventional high-strength aluminum-based alloy material (duralumin), it is understood that the consolidated materials according to this invention are superior over the entire Zr content range of 0–3 at. %.

EXAMPLE 5

As in Example 1 described above, extruded materials (consolidated materials) having the various compositions shown in Table 1 were prepared and their mechanical properties (tensile strength $\sigma$, elongation $\epsilon$) at room temperature were investigated. The results are also shown in Table 1. It is to be noted that the minimum elongation (2%) required for ordinary working operations was obtained by all the consolidated materials shown in Table 1. It is understood from Table 1 that the consolidated materials according to the present invention have excellent properties in tensile strength and elongation.

TABLE 1

| | Composition (at. %) | $\sigma$(MPa) | $\epsilon$(%) |
|---|---|---|---|
| Invention Sample 1 | $Al_{90.2}Ni_8Ti_{0.3}Mm_{1.5}$ | 962 | 9.1 |
| Invention Sample 2 | $Al_{91}Ni_7Zr_{0.4}Mg_{0.4}Mm_{1.2}$ | 1064 | 5.2 |
| Invention Sample 3 | $Al_{89.5}Ni_{8.2}Ti_{0.2}Si_{0.3}Mm_{1.8}$ | 1004 | 4.6 |
| Invention Sample 4 | $Al_{91.2}Ni_{6.5}Zr_{0.8}Mg_{0.5}Si_{0.3}Mm_{0.7}$ | 978 | 7.7 |
| Invention Sample 5 | $Al_{88.8}Ni_{7.1}Ti_{0.8}Mg_{0.5}Cu_{0.3}Mm_{2.5}$ | 980 | 6.1 |
| Invention Sample 6 | $Al_{89.2}Ni_8Zr_{1.2}Ti_{0.3}Mg_{0.3}Mm_1$ | 974 | 8.9 |
| Invention Sample 7 | $Al_{88.9}Ni_7Zr_{0.4}Ti_{0.5}Si_{1.7}Mm_{1.5}$ | 1038 | 5.1 |
| Invention Sample 8 | $Al_{90.4}Ni_9Ti_{0.1}Mm_{0.5}$ | 993 | 7.6 |
| Invention Sample 9 | $Al_{90.2}Ni_{5.2}Ti_2Cu_{1.6}Mm_1$ | 957 | 9.1 |
| Invention Sample 10 | $Al_{89.9}Ni_{7.4}Ti_{0.4}Mg_{1.8}Mm_{0.5}$ | 1009 | 6.4 |
| Invention Sample 11 | $Al_{90.8}Ni_7Zr_{0.4}Mg_{0.4}Mm_{1.2}Zn_{0.2}$ | 1080 | 4.7 |
| Invention Sample 12 | $Al_{89.5}Ni_{7.4}Ti_{0.4}Mg_{1.8}Mm_{0.5}Zn_{0.4}$ | 1022 | 4.9 |
| Invention Sample 13 | $Al_{89.5}Ni_8Mm_{0.3}Zr_{2.2}$ | 921 | 2.2 |
| Invention Sample 14 | $Al_{89.9}Ni_7Mm_{0.1}Zr_3$ | 968 | 2.0 |

TABLE 1-continued

| | Composition (at. %) | σ(MPa) | ε(%) |
|---|---|---|---|
| Invention Sample 15 | $Al_{89.2}Ni_{7.8}Mm_{0.2}Ti_{2.8}$ | 1002 | 4.3 |
| Invention Sample 16 | $Al_{90}Ni_7Zr_{2.6}Mg_{0.2}Mm_{0.2}$ | 1038 | 3.2 |
| Invention Sample 17 | $Al_{88.6}Ni_{8.1}Ti_{2.7}Si_{0.2}Mm_{0.4}$ | 988 | 4.9 |
| Invention Sample 18 | $Al_{90}Ni_{6.4}Zr_{2.5}Mg_{0.6}Si_{0.2}Mm_{0.3}$ | 980 | 3.4 |
| Invention Sample 19 | $Al_{88}Ni_9Ti_{2.1}Mg_{0.3}Cu_{0.2}Mm_{0.4}$ | 1006 | 2.4 |
| Invention Sample 20 | $Al_{90.8}Ni_7Zr_{1.2}Mg_{0.4}Mm_{0.4}Zn_{0.2}$ | 991 | 5.2 |
| Invention Sample 21 | $Al_{89.5}Ni_{7.6}Ti_{0.5}Mg_{1.8}Mm_{0.2}Zn_{0.4}$ | 1024 | 2.9 |
| Comparative Sample 1 | $Al_{88.5}Ni_8Mm_{3.5}$ | 930 | 0.6 |
| Comparative Sample 2 | $Al_{90.5}Ni_8Mm_{1.5}$ | 890 | 2.2 |

With respect to the solidified materials obtained above in Examples 1-5, TEM observation was conducted. The above solidified materials were found to be formed of a matrix of aluminum or a supersaturated solid solution of aluminum, the aluminum or solid solution having a mean crystal grain size of 40-1000 nm, and to contain grains of a stable or metastable phase of various intermetallic compounds formed of the matrix element and the other alloying elements and/or of various intermetallic compounds formed of the other alloying elements, said grains being distributed evenly in the matrix, and the intermetallic compounds have a mean grain size of 10-800 nm.

In Examples 1-5, the mechanical properties at room temperature were described. As consolidated Al-Ni-Mm materials, on which the consolidated materials according to the present invention were developed, have excellent strength at elevated temperatures as disclosed in Japanese Patent Application Laid-Open (Kokai) No. HEI 3-181065, the consolidated materials according to the present invention are also excellent in mechanical properties (tensile strength, elongation) at elevated temperatures and can be effectively worked into shaped high-strength materials by warm or hot working (at temperatures ranging from room temperature to about 400° C.).

Consolidated aluminum-based alloy materials according to the present invention are excellent in elongation (toughness) so that they can withstand secondary working operations when the secondary working operations are conducted. The secondary operations can therefore be performed with ease while retaining the excellent properties of their raw materials as they are. In addition, such consolidated materials can be obtained by a simple process, that is, by simply compacting powder or flakes, which have been obtained by quench solidification, and then subjecting the thus-compacted powder or flakes to plastic working.

What is claimed is:

1. A compacted and consolidated aluminum-based alloy material which has been obtained by compacting and consolidating a rapidly solidified material having a composition represented by the general formula: $Al_a$-$Ni_bX_cM_d$, wherein X is one or two elements selected from La and Ce or an Mm (mischmetal); M is one or two elements selected from Zr and Ti; a, b, c and d are, in atomic percentages, $84 \leqq a \leqq 94.8$, $5 \leqq b \leqq 10$, $0.1 \leqq c \leqq 3$, and $0.1 \leqq d \leqq 3$.

2. A compacted and consolidated aluminum-based alloy material which has been obtained by compacting and consolidating a rapidly solidified material having a composition represented by the general formula: $Al_{a'}$-$Ni_bX_cM_dQ_e$, wherein X is one or two elements selected from La and Ce or an Mm (mischmetal); M is one or two elements selected from Zr and Ti; Q is at least one element selected from Mg, Si, Cu and Zn, and a', b, c, d and e are, in atomic percentages, $82 \leqq a' \leqq 94.6$, $5 \leqq b \leqq 10$, $0.1 \leqq c \leqq 3$, $0.1 \leqq d \leqq 3$, and $0.2 \leqq e \leqq 2$.

3. A compacted and consolidated alumina-based alloy material according to claim 1, wherein said compacted and consolidated aluminum-based alloy material is formed of a matrix of alumina or a supersaturated aluminum solid solution, whose means crystal grain size is 40-1000 nm, and grains made of a stable or metastable phase of various intermetallic compounds formed from at least two members selected from the group consisting of Al, Ni, La, Ce, Mm, Zr and Ti distributed evenly in the matrix; and the intermetallic compounds have a mean grain size of 10-800 nm.

4. A compacted and consolidated alumina-based alloy material according to claim 2, wherein said compacted and consolidated aluminum-based alloy material is formed of a matrix of alumina or supersaturated aluminum solid solution, whose mean crystal grain size is 44-1000 nm, and grains made of a stable or metastable phase of various intermetallic compounds formed from at least two members selected from the group consisting of Al, Ni, La, Ce, Mm, Zr, Ti, Mg, Si, Cu and Zn distributed evenly in the matrix; and the intermetallic compounds have a means grain size of 10-800 nm.

5. A process for the production of a compacted and consolidated aluminum-based alloy material, the process comprising:

melting a material having a composition represented by the general formula: $Al_aNi_bX_cM_d$, wherein X is one or two elements selected from La and Ce or an Mm; M is one or two elements selected from Zr and Ti; a, b, c and d are, in atomic percentages, $84 \leqq a \leqq 94.8$, $5 \leqq b \leqq 10$, $0.1 \leqq c \leqq 3$, and $0.1 \leqq d \leqq 3$;

quenching and solidifying the resultant molten material into powder or flakes;

compacting the powder or flakes; and compressing, forming and consolidating the thus-compacted powder or flakes by conventional plastic working.

6. A process for the production of a compacted and consolidated aluminum-based alloy material, the process comprising:

melting a material having a composition represented by the general formula: $Al_{a'}Ni_bX_cM_dQ_e$, wherein X is one or two elements selected from La and Ce or an Mm; M is one or two elements selected from Zr and Ti; Q is at least one element selected from Mg, Si, Cu and Zn; and a', b, c, d, and e are, in atomic percentages, $82 \leqq a' \leqq 94.6$, $5 \leqq b \leqq 10$, $0.1 \leqq c \leqq 3$, and $0.1 \leqq d \leqq 3$, and $0.2 \leqq e \leqq 2$;

quenching and solidifying the resultant molten material into powder or flakes;

compacting the powder or flakes; and compressing forming and consolidating the thus-compacted powder or flakes by conventional plastic working.

7. A process for the production of a compacted and consolidated alumina-based alloy material according to claim 5, wherein said consolidated material is formed of a matrix of aluminum or a supersaturated aluminum solid solution, whose mean crystal grain size is 40-1000 nm, and grains made of a stable or metastable phase of various intermetallic compounds formed from at least two members selected from the group consisting of Al, Ni, La, Ce, Mm, Zr and Ti distributed evenly in the matrix; and the intermetallic compounds have a mean grain size of 10–800 nm.

8. A process for the production of a compacted and consolidated alumina-based alloy material according to claim 6, wherein said consolidated material is formed of a matrix of aluminum or supersaturated aluminum solid solution, whose mean crystal grain size is 40–1000 nm, and grains made of a stable or metastable phase of various intermetallic compounds formed from at least two members selected from the group consisting of Al, Ni, La, Ce, Mm, Zr, Ti, Mg, Si, Cu and Zn distributed evenly in the matrix; and the intermetallic compounds have a mean grain size of 10–800 nm.

* * * * *

UNITED STATES PATENT AND TRADEMARK OFFICE

CERTIFICATE OF CORRECTION

PATENT NO. : 5,264,021

DATED : November 23, 1993

INVENTOR(S) : Kazuhiko Kita et al

It is certified that error appears in the above-identified patent and that said Letters Patent is hereby corrected as shown below:

Column 8, line 13; change "means" to ---mean---.

Column 8, line 60; after "compressing" insert a comma (,).

Column 9, line 9; after "or" insert ---a---.

Signed and Sealed this

Third Day of May, 1994

*Attest:*

*Attesting Officer*

BRUCE LEHMAN

*Commissioner of Patents and Trademarks*